US008931978B2

(12) United States Patent
Ditillo et al.

(10) Patent No.: US 8,931,978 B2
(45) Date of Patent: Jan. 13, 2015

(54) TOOL FOR THIN DIAPHRAGMS

(75) Inventors: Alessandro Ditillo, Cesena (IT); Marco Casadel, Cesena (IT); Ezio Biserna, Cesena (IT)

(73) Assignee: Soilmec S.p.A., Cesena (IT)

( * ) Notice: Subject to any disclaimer, the term of this patent is extended or adjusted under 35 U.S.C. 154(b) by 208 days.

(21) Appl. No.: 13/516,652

(22) PCT Filed: Nov. 15, 2010

(86) PCT No.: PCT/EP2010/006948

§ 371 (c)(1),
(2), (4) Date: Sep. 18, 2012

(87) PCT Pub. No.: WO2011/072783

PCT Pub. Date: Jun. 23, 2011

(65) Prior Publication Data

US 2013/0017020 A1 Jan. 17, 2013

(30) Foreign Application Priority Data

Dec. 15, 2009 (IT) ..... TO2009A0988

(51) Int. Cl.

| | |
|---|---|
| ***E02D 3/12*** | (2006.01) |
| ***E02D 17/13*** | (2006.01) |
| ***E02D 19/18*** | (2006.01) |
| ***E02D 5/18*** | (2006.01) |

(52) U.S. Cl.

CPC *E02D 3/126* (2013.01); *E02D 5/18* (2013.01); *E02D 17/13* (2013.01); *E02D 19/18* (2013.01)

USPC ..... 405/263; 405/258.1

(58) Field of Classification Search

USPC ..... 405/258.1, 263, 266, 267, 269; 30/304, 30/503.5

See application file for complete search history.

(56) References Cited

U.S. PATENT DOCUMENTS

| | | | | |
|---|---|---|---|---|
| 2,048,710 | A * | 7/1936 | Ranney | 405/267 |
| 4,694,915 | A | 9/1987 | Bauer et al. | |
| 4,718,504 | A | 1/1988 | Terashima et al. | |
| 4,785,559 | A * | 11/1988 | Hentschel | 37/94 |

(Continued)

FOREIGN PATENT DOCUMENTS

| | | |
|---|---|---|
| DE | 103 60 910 | 9/2005 |
| EP | 1 630 297 | 3/2006 |

(Continued)

OTHER PUBLICATIONS

International Search Report for International Application No. PCT/EP2010/006948 mailed Jul. 27, 2011.E.

*Primary Examiner* — Tara M. Pinnock
(74) *Attorney, Agent, or Firm* — Merchant & Gould P.C.

(57) ABSTRACT

A cutting/mixing tool for thin diaphragm walls is mounted at the end of at least one drilling rod (47) moved by a slidable assembly (42, 62) along a tower (41), carried by an operating drilling machine (40). The tool (45) has a body (10), which bears in its central part two digging/mixing wheels (20*a*, 20*b*) provided on the periphery with cutters (82) and set alongside one another at a minimum distance (d) and coaxial about an axis (x) substantially perpendicular to the direction of digging (z). The wheels (20*a*, 20*b*) project from slits (81) of the body (10), which contains at least partially means (1-4, 50-52) for transmission of motion to the wheels, the devices being positioned externally with respect to the wheels.

16 Claims, 5 Drawing Sheets

(56) References Cited

U.S. PATENT DOCUMENTS

| | | | | |
|---|---|---|---|---|
| 5,275,513 | A | 1/1994 | Geary, Jr. et al. | |
| 7,278,228 | B2 | 10/2007 | Azberger et al. | |
| 7,765,723 | B2 * | 8/2010 | Chagnot et al. | 37/94 |
| 8,020,323 | B2 * | 9/2011 | Chagnot et al. | 37/189 |
| 2004/0035007 | A1 * | 2/2004 | Burgess | 30/307 |
| 2004/0256908 | A1 * | 12/2004 | Risi | 299/78 |
| 2006/0037218 | A1 * | 2/2006 | Stoetzer | 37/352 |

FOREIGN PATENT DOCUMENTS

| | | |
|---|---|---|
| EP | 1 746 213 | 1/2007 |
| EP | 1 748 110 | 1/2007 |
| IT | 1189612 | 2/1988 |

* cited by examiner

TOOL FOR THIN DIAPHRAGMS

This application is a National Stage Application of PCT/EP2010/006948, filed 15 Nov. 2012, which claims benefit of Serial No. TO2009A000988, filed 15 Dec. 2009 in Italy and which applications are incorporated herein by reference. To the extent appropriate, a claim of priority is made to each of the above disclosed applications.

BACKGROUND

The present invention belongs in the field of technologies for compacting soil obtained by disaggregation of the soil with corresponding mixing through the addition of compacting agents under pressure (cement grout, chemical mixtures, etc.) or additives that are injected through the equipment itself.

More in particular, it refers to execution of thin panels in which the thickness is very limited in comparison with the longitudinal dimensions.

The traditional procedure, with which a prevalently mechanical mixing is carried out, exploits the rotary motion of tools capable of digging and disaggregating the soil via appendages that extend radially with respect to the axis of the tool itself. The soil thus disaggregated is mixed with a cementing mixture pumped at low pressure (1-2 MPa) through mouths made in the tubular shaft in the proximity of the blades.

The limit of the above system is the shape of the cross section, which is very far from the theoretical shape of a diaphragm, and typically solutions are adopted with a plurality of tools set alongside one another having smaller diameters so as to approach the ideal shape.

For example, the technical solution described in U.S. Pat. No. 5,275,513 is very complex both as regards the movement and as regards the possibility of application on equipment that has to support and supply these types of tools.

A further known variant of the procedure described above is to use higher pressures for the cementing mixes.

The above technique, by exploiting the combination of the mechanical action of the disaggregating members of the tool and of the hydraulic energy of the pressure jets, is distinguished by a considerable speed of execution, with considerable economic advantages, but there still remain the same limits as regards the shape of the cross section that can be obtained.

In more recent times, the mixing techniques have resorted to machines bearing a pair of wheels provided with digging/mixing teeth or appendages, of the type described in EP-1,748,110, which are set up against one another and have axes of rotation that are substantially horizontal and normal to the axis of the dig.

This new equipment, commonly referred to as "milling wheels" or simply "milling cutters", execute, as in the case of traditional mechanical mixing, a compacted section of given depth but of a rectangular, instead of circular, shape. As in the case of the first method described, also these machines can exploit, in addition to the mechanical effect, the disaggregating effect of the hydraulic energy of the pressure jets.

Unlike systems with rotating vertical axis, in which the members for generation of the motion are located above the ground, in milling cutters the motor members are set in the part of equipment that penetrates in the ground, up against the drums or inside the drums.

The rectangular shape, obtained with said equipment, enables an extremely high performance to be achieved as compared to the circular shape of the first systems described above in so far as, when a continuous linear diaphragm wall is to be made, it is far less costly and in any case faster to set alongside one another a number of rectangular diaphragms, slightly compenetrating one another, rather than circumferences secant with respect to one another.

The thicknesses required for the diaphragms in some types of works may be relatively large as compared to the transverse dimension of digging reaching ratios close to 1:2. There also exist applications, which are the ones specific to the present invention, in which the thicknesses have to be reduced as much as possible, and in this case it could be obtained ratios of 1:5, 1:10, 1:20, etc. The ideal section would be represented by a rectangle having the major side as long as possible, and the minor side around 200-500 mm in length, i.e., just enough to ensure continuity between two adjacent rectangular diaphragms.

The current solutions and the geometrical shapes of the motor members, transmission members, and cutting members adopted up to now do not, however, enable reduction of the width of the dig to a value of less than 500-600 mm.

U.S. Pat. No. 4,694,915 describes an apparatus (milling cutter) for digging diaphragm walls constituted by two cutting wheels. Each of them is mounted on a supporting structure, which is equipped with a member for transmission of motion, positioned inside the two wheels. The wheels can be set in rotation by single or separate motor members, turning in the same direction.

The main limit of this solution is that it is unable to dig right through the thickness of the cross section as the wheels must leave space for the internal transmission or for their support. If the thickness is reduced in order to obtain a thin diaphragm wall and the digging capacity (torques and powers involved) is kept constant, it is evident that, since the internal transmission has to remain unvaried, its overall dimensions will assume an increasing incidence as the thickness of the diaphragm decreases.

Fall-back solutions known in the field of diaphragm walls of large thickness, used for removing the central area, for example adopting mobile teeth (see, for example, document No. DE 10360910), or else generating movements transverse to the milling head through the use of pivoting supporting plates (see, for example, document No. EP 1746213), which can be moved during the excavation in order to cover the entire section, will not be able to find effective application if the thicknesses are small, and in any case represent a considerable structural complication.

It is also known the Italian patent IT-1,189,612, which describes and claims an apparatus (milling cutter) for digging diaphragm walls, equipped with a plurality of milling wheels and a motor-driven rotating central tip.

Since said solution envisages a series of internal gears, it does not permit the reduction of the transverse dimensions of the diaphragm wall. Given the geometry of the kinematic chain, the motor is set transverse, and this prevents reduction of the dimensions thereof into a really compact form. If the aim is to set the motor in a vertical position, it would be necessary to complicate the transmission further by adopting an additional transmission at 90° at the expense of simplification, which is already particularly critical.

In addition, the head has the purpose of digging the part of ground comprised between the plurality of wheels present, hence only in the internal portion.

The geometry of the wheels is such to present a ratio between the diameter of the wheels and the thickness that is approximately 1:1, with consequent limits on the execution of thin panels, as in the case of the previous solution.

SUMMARY

The purpose of the present invention is to overcome the above problems by providing a thin digging section, as close as possible to the optimal section.

In order to achieve the above and further purposes that will be better understood in the following description, the present invention describes a digging and mixing equipment for executing diaphragm walls.

BRIEF DESCRIPTION OF THE DRAWINGS

The invention will now be described with reference to the attached figures, which illustrate a non-limiting example of embodiment thereof and in which.

DETAILED DESCRIPTION

Figure 1A:
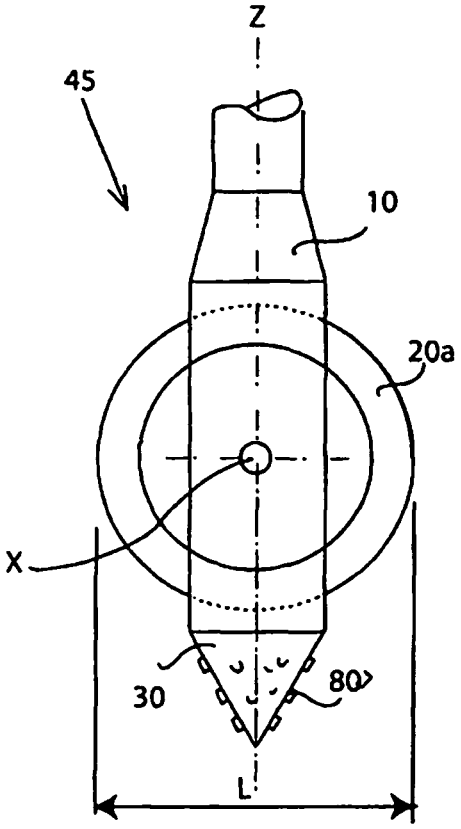
FIGS. 1, 1*a*, and 1*b* show the device according to the invention in a plan view, in a front view, and in a side view, respectively.
Figure 1B:
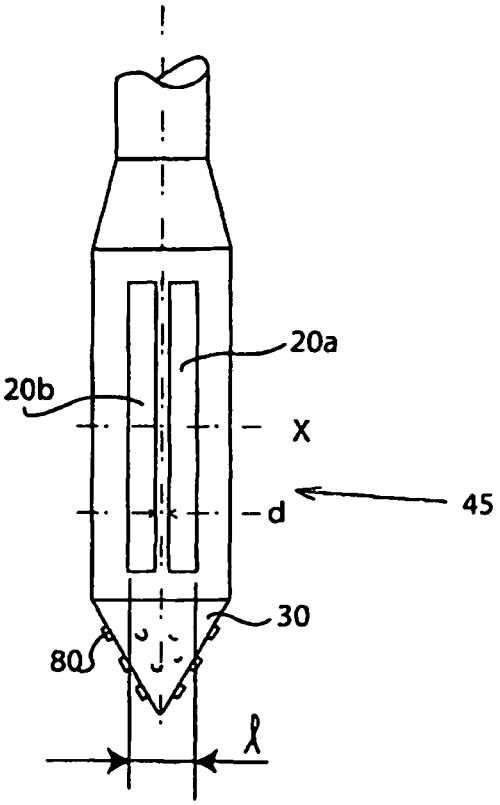
Figure 1:
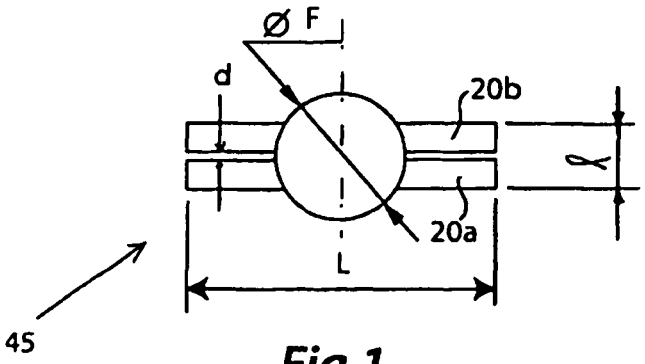

With reference to FIG. 1, it is shown the current cross section of the diaphragm wall that it will be possible to execute with the equipment according to the invention, which is basically formed by a very elongated rectangle of dimensions Lxl, compenetrated at the centre by a circular section of diameter F not excessively greater than the minor side 1 of the diaphragm wall, but even so able to contain the members adapted for transmission of motion of the digging and mixing parts.

As better shown in FIGS. 1A and 1B, the equipment forming the subject of the invention has a body 10, which is static with respect to its own digging axis z and bears in its central part two digging/mixing wheels 20*a*, 20*b* of considerable diameter, mounted coaxial and preferably counter-rotating about the axis x, perpendicular to the direction of digging z; the wheels are set facing one another at a minimum distance d so that no structural part for supporting the wheels on the body will be set between the wheels themselves. The latter are thus able to dig the rectangular diaphragm Lxl, assisted by a plurality of pressure jets.

Figure 8B:
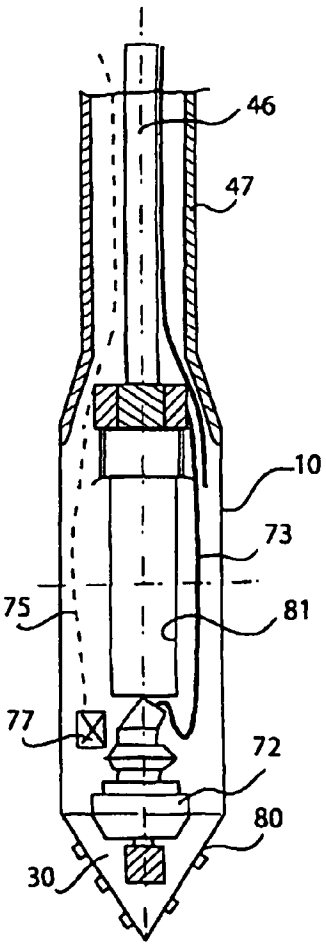
FIGS. 8*a* and 8*b* are further variants of FIG. 8.
Figure 8A:
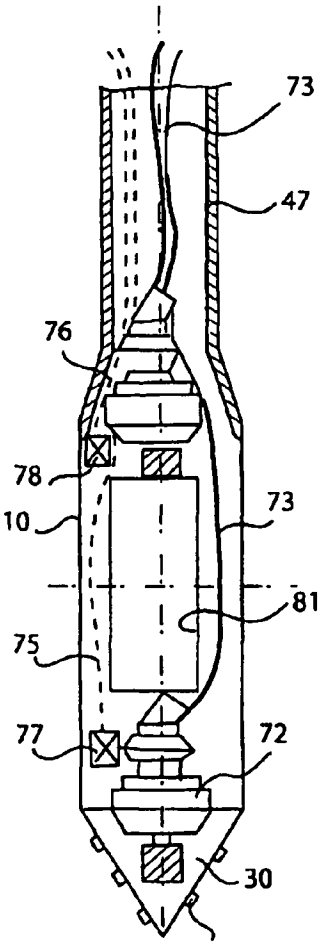
Figure 6:
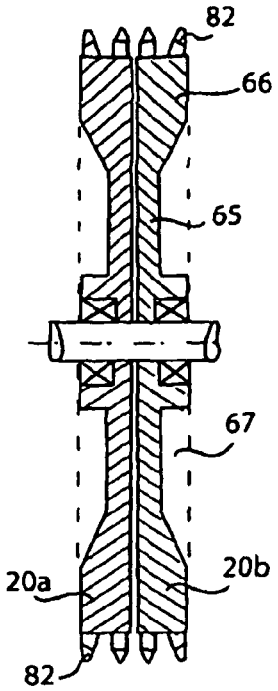
FIG. 6 is a cross section of the tools of the device according to the invention.
Figure 9B:
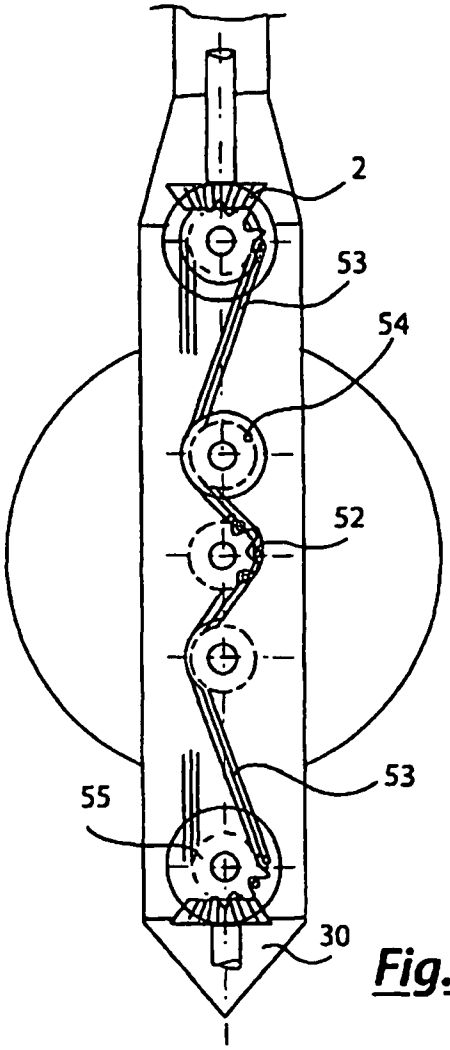
FIGS. 9*a* and 9*b* are a partial vertical section and a front view, respectively, of a further variant of the embodiment of FIGS. 1, 1*a*, 1*b*, and 2.
Figure 9A:
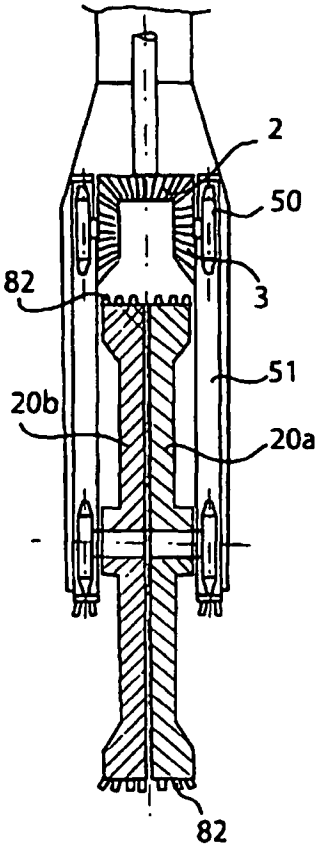

As shown in FIGS. 6 and 9*a*, the wheels are provided on their periphery with digging/mixing tools 82 and, as shown in FIGS. 8*a* and 8*b*, project from body 10 through lateral slits 81 of its own.

A tip 30, at the terminal end of body 10, is also equipped with cutting means and is able to turn with respect to the axis of body 10 coinciding with the axis of digging; tip 30 facilitates driving of the equipment into the ground contributing the making of the hole for the passage of diameter F of body 10.

Figure 2:
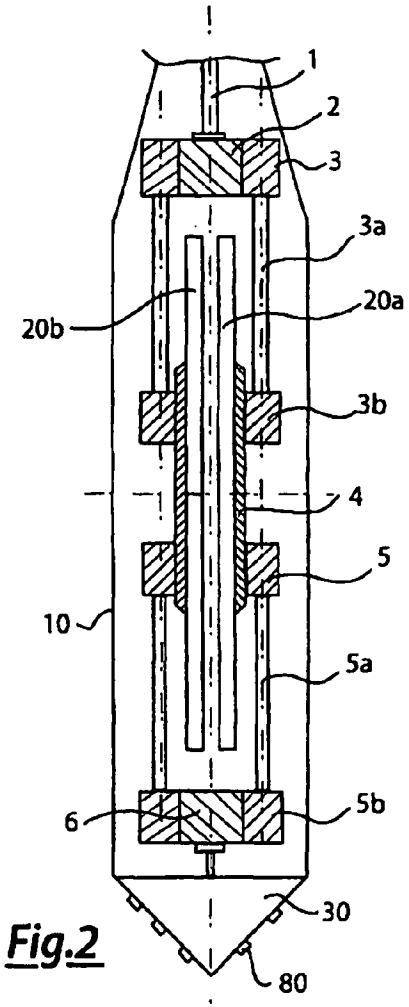
FIG. 2 is a vertical section of the device of the previous figures.

Body 10, in the configuration under examination, is as shown in FIG. 2, i.e., with a shaft 1, fitted on which is a pinion 2, which receives the motion from a motor member external to the digging equipment and transmits it to a pair of pinions 3, which, via shaft 3*a* and twin pinion 3*b*, transfer the motion to a crown wheel 4 fixed with respect to each of digging wheels 20*a*, 20*b*.

The kinematic transmission of pinions 2 and 3 can also be provided as stage of an epicyclic gearing.

The transmission between pinion 3*b* and wheel 4 may be of the "spur gear" or "face gear" type.

The preselected configuration allows the wheels to be counter-rotating with respect to one another in order to double the action of cutting and disaggregation of the ground by adding the relative velocities of the rotating means. Crown 4 itself transmits the motion to members 5, 5*a*, 5*b*, which are altogether specular to elements 3, 3*a*, 3*b* described previously. Pinions 5*b* supply final wheel 6, which causes rotation of toothed tip 30.

The mechanical transmission system described above can be obtained also with the use of chains motor-driven by toothed pinions (see FIGS. 9*a* and 9*b*).

Pinions 2 and 3 in this case constitute a bevel gear, and pinion 50, fixed with respect to gear 3, is winded by a chain 51 transmitted in 54 (which guarantees the increase in the teeth meshing between the chain and pinion 52) to engage a central pinion 52, which transmits the motion to digging wheels 20*a*, 20*b*.

The chain can proceed its specular extension downwards with branch 53 that is winded on pinion 55, which transmits the motion to tip 30.

From a dimensional analysis it has been verified how these solutions for supplying the motion of the wheels and of the tip, given the same power, imply a larger size of diameter F.

Figure 3D:
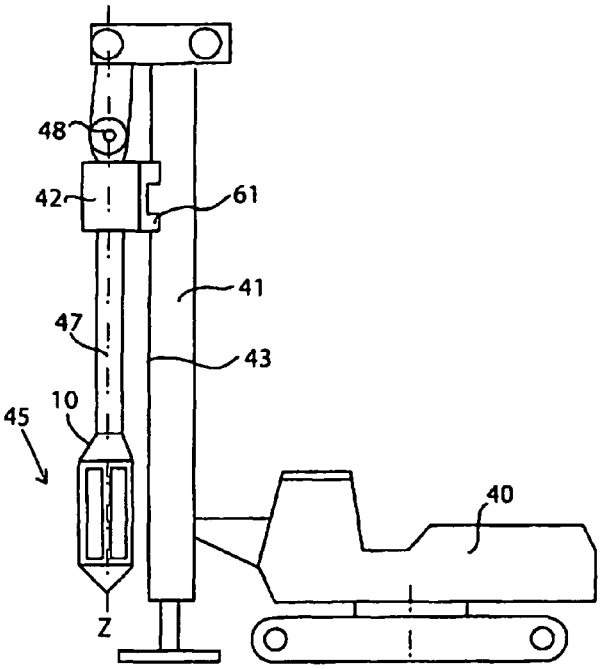
FIGS. 3*a* and 3*b* show the machine provided with the device according to the invention in side view and front view, respectively.
Figure 3B:
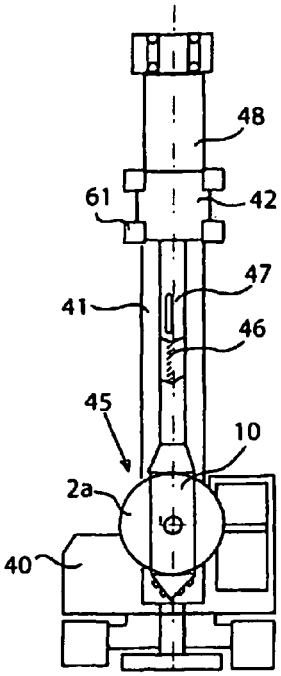

With reference to FIGS. 3*a* and 3*b* it is noted that, as in the case of commonly used milling cutters, the present equipment is supported by an operating machine 40 (specific for drilling or hoisting cranes and/or application in the foundations sector), normally provided with tracks, equipped with a drilling tower 41, along which it slides an assembly for movement of drilling rods commonly known as "rotary table".

This rotary table moves along guides 43 of the tower being connected to one or more movement devices, preferably winches, of the pull-up or pull-up/pull-down type for enabling hoisting or hoisting and thrust of tool 45 from/into the ground. The lines of the winch can be direct or multiplied.

The rotary table, which is prevalently of the hydraulic type, converts the energy supplied by a pressurized fluid into mechanical energy. One or more hydraulic motors impress the rotary motion on one or more gears coupled to a crown wheel fitted to the first of digging rods 46 located inside external rods 47.

Figure 4:
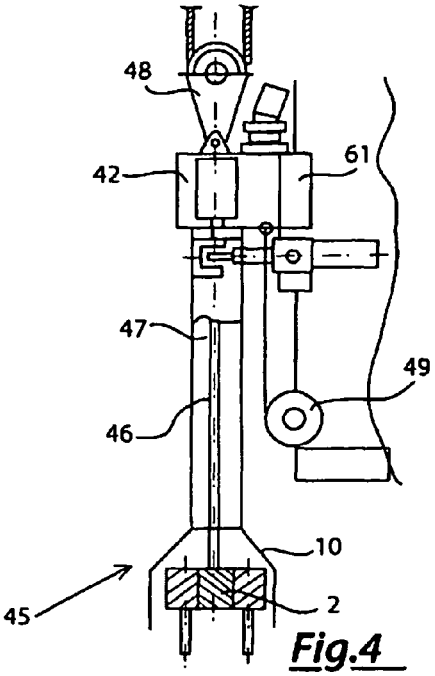
FIG. 4 is a detail of the machine provided with the device according to the invention.

With reference to FIG. 4 it may be noted that external rod 47 can be fixed in a preferential way to rotary table 42 and enable hoisting/driving of body 10 by means of hoisting tackle 48 and thrust tackle 49 fixed to the movement structures and/or directly to rotary table 42.

The rotary motion of digging/mixing is thus transmitted from rotary table 42 to tool 45 by means of internal rods 46.

The motion of hoisting and driving is, instead, transmitted from the mechanical means connected to rotary table 42 through external rods 47.

As shown in FIG. 4, external rods 47 can be rendered temporarily releasable with respect to the digging axis z, being possible thus to control the angular direction of tool 45 with respect to a pre-set mounting direction. By driving the connection between the external rod and the rotary table or its motion carriage, it is possible to position digging wheels 20*a*, 20*b* according to a pre-set inclination (angle α of FIG. 5) with respect to the positioning of drilling tower 41.

Figure 5:
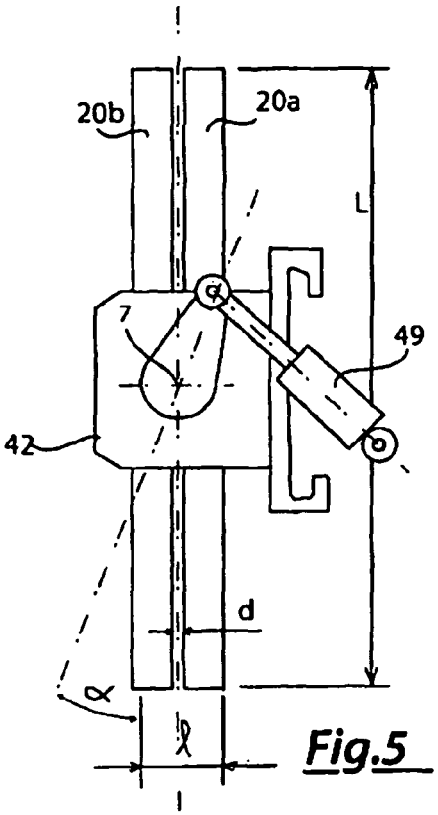
FIG. 5 is an application of the device according to the invention.

Provision of the motor drive for the angular-positioning system is obtained by known systems, such as linear actuator 49, preferentially hydraulic cylinders, as shown in FIG. 5, motors or motor-reducers, all of which can be remotely driven and controlled with electrical or hydraulic signals.

In the case where the movement device is constituted by a winch with simple winding (with pull, without thrust), the tool can be hoisted with a pre-defined pull, whereas it will penetrate in the ground as a result of its own weight and the weight of the equipment connected thereto and suspended to tackle 48.

This solution thus simplified can be used in particularly "easy" soils in which the resistance to advance is very low.

Figure 4A:
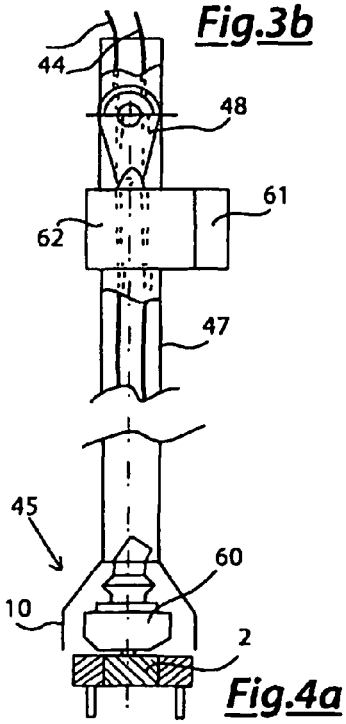
FIG. 4*a* is a variant of FIG. 4.

With reference to FIG. 4*a*, a first variant of the aforesaid solution is shown, in which a power assembly (e.g., a motor-reducer) 60 is housed within body 10 in the proximity of motor pinion 2. In this case, the connection rod is just one and coincides with external rod 47. Inside rod 47 there are contained supply pipes 44, which reach up to hoisting assembly 62.

The assembly is no longer motor-driven as a conventional rotary, but preserves runners 61 thereof for sliding and guiding along the antenna. In this case, external rods 47 can project with respect to hoisting assembly 62, thus decidedly increasing the digging depth.

As previously described, it is possible to set between rod 47 and hoisting assembly 62 orientation system 49 (which at one end is connected to rod 47 and at the other is directly or indirectly connected to guide tower 41), which enables angular positioning of digging tool 45 with respect to the digging/moving direction z (FIG. 5).

With reference to FIG. 6, the two wheels 20*a* and 20*b* do not present any obstacle in their relative approach in order to restrict the digging/mixing section. Digging/mixing wheels 20*a* and 20*b* have a non-homogeneous cross section with a wall 65 that is relatively slender, and an annular portion 66 of considerable dimensions in order to concentrate heavy weights at the greater distances.

In this way, it is possible to exploit the masses as a flywheel capable of overcoming more resistant obstacles that require additional torque to the wheels, without slowing down excessively or stopping completely rotation thereof.

The wheels are designed, in fact, with a considerable diameter (ratio L/l from 5 to 15, but also higher values are possible). As a consequence of the large diameter of the wheels, it is necessary to limit the number of revolutions so as to contain the peripheral velocity of the digging/mixing elements. The large diameter enables the high peripheral velocities to be reached easily, which, combined with the flywheel masses, favours penetration of the teeth into the ground and gives stability to the mixing system for a more effective homogeneization.

The external shape of the wheels (see FIG. 6), can be filled with additional elements 67 made of light material (e.g., plastics), which generate a perfectly cylindrical shape and transform the shape of the wheel into a cylindrical disk. These elements are useful to simplify the opening cut on the structure for passage and containment of wheels 20*a*, 20*b* and can be used as replaceable wear elements.

Figure 7:
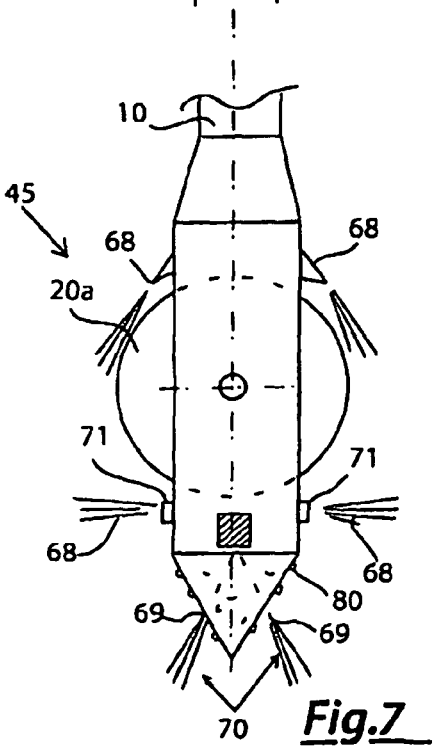
FIG. 7 is a view like the one of FIG. 1*a* with fluid-supply nozzles applied thereon.

With reference to FIG. 7, digging and mixing tool 45 is equipped with a plurality of injection nozzles 68, variously positioned and angled, for introduction into the ground of the fluids used, which, as has been said previously, can be of various types. The pressure of the fluids can be low (less than 2-5 MPa) or else high (more than 5 MPa, and generally up to 50 MPa). The injection ducts themselves can be doubled for carrying out a bi-fluid treatment with air (at a low pressure generally up to 2.5 MPa) and a compacting mixture coaxial to the previous one and contained by the jet of air, at a low or high pressure.

Known in the sector are all the variants that can be obtained and the corresponding characteristics that they can produce by modifying: the amount (mono-fluid treatment, bi-fluid treatment, tri-fluid treatment, etc.), the arrangements (coaxial, lateral, mounted in one and the same plane, mounted in staggered planes, inclined, horizontal, tangential so as to skim the teeth), the functional modes (whether injected during advance, during extraction, or in both steps), the extension of the treatment (whether injected for a certain depth or for the entire extension of the entire diaphragm wall). These variants modify the process of execution, without thereby departing from the solution claimed.

Mouths 69 on digging tip 30 that is also equipped with cutting means 80, enable injection of drilling fluids 70 (generally water) during digging, in order to facilitate removal of debris and cool down the tip itself. During ascent, a valve 71 calibrated at a pressure lower than that of the injection of the grout occludes the ducts directed to mouths 69 in order to orient the flow rate of the mixture exclusively on mouths 68 located in a position corresponding to wheels 20*a* and 20*b*. By so doing, the supply duct can be unique and supply both the tip and the injection mouths, to the advantage of simplification.

Mixing/digging teeth are set on the periphery of wheels 20*a*, 20*b*; favoured by the correct speed of rotation and the regular motion of the wheels, they spread the fluid injected over the entire section and mix it finely to the soil continuing the disaggregating action.

Figure 8:
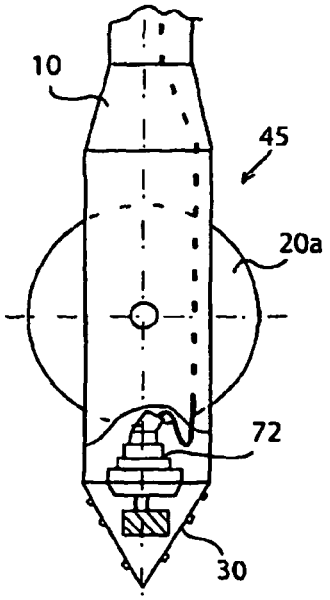
FIG. 8 is a variant of FIG. 2.

FIG. 8 represents a second variant of the solution that can be combined to both the previous versions. In this case, tip 30 has a motion independent from that of wheels 20*a*, 20*b* and in particular obtained with a power assembly 72 (for example, of the hydraulic motor or motor-reducer type) like assembly 60 previously described (FIG. 4*a*).

Said assembly is supplied with pipes 73, which pass inside rod 47 in the first variant of FIG. 8*a*, whereas for the initial solution of FIG. 8*b*, the gap between external rod 47 and internal rod 46 is exploited, or else the pipes are made to pass in internal rod 46 provided with a number of (coaxial or independent) passages.

In the same way, it is possible to house signal cables 75, 76 for positioning of instruments 77, 78 necessary for monitoring the compaction process. Inclination sensors and accelerometers can be inserted to verify the effective digging direction of the tip, as well as generic sensors for detecting the pressure of the motor-reducer or the r.p.m. (in the case of the first and second variants).

The operating modes of execution of the treatment envisage a first step in which tool 45 is inserted into the ground by means of its own weight or with the aid of an external thrust exerted by the machine and transmitted through the battery of rods.

During this step, to guarantee penetration of the body in the ground, since the body has larger dimensions than the wheels, a proper drilling is carried out with tip 30.

It is convenient for wheels 20*a*, 20*b* to be set in rotation outside the hole in such a way that they reach the steady-state speed, optimal for cutting/mixing.

The flywheel masses and the diametral dimensions enable conservation of a rotational energy useful for stabilizing the cut and for disaggregation of the ground.

During descent, the counter-rotating wheels impress a reaction torque on the external rods, which is partially balanced by the torque at digging tip 30 so that the rods will be temporarily constrained to the drilling tower to keep the tool in the desired direction.

The articulation present between rods 47 and rotary table 42 or hoisting assembly 62 enables angular orientation of the tool before or during the excavation itself.

The presence of a linear actuator 49, as shown in FIG. 5, also enables measurement of the unbalancing torque of the two wheels 20*a*, 20*b* given its lever arm and the pressure of reaction, which can be measured.

Once the design depth has been reached, the tip and the wheels are permanently kept in motion so that they can hence start the step of treatment in which the compaction mix is injected. If the injection is at a high pressure, a valve 71 closes the passage to the tip and enables supply of injection mouths 68.

Mixture of the binder with the soil is obtained via the mechanical action of the teeth on the soil with the opposite relative motion of the wheels combined with the hydraulic energy possessed by the liquids injected.

The treatment proceeds down to the depth expected or up to the top.

Movements of ascent and descent favour homogeneization of the layers also in the vertical direction.

Alternatively, the injection of the compacting fluids can be made right from the start, during the step of descent. In this case, the injected material that will disaggregate the soil will come out both from tip 69 and from mouths 68.

Another variant is the injection during drilling and extraction.

At the end of the treatment, it is possible to lower a cylindrical reinforcement into the hole ØF, to reinforce the pile that will have structural functions.

Last variant of the method: a drilling machine drills a pre-hole throughout its length, with diameter ØF. In this way, the mixing equipment can be without the tip and make only the thin diaphragm wall according to one of the previous methododologies of execution already described. The rectilinearity of the pre-drilled hole guarantees guiding of tool 45 throughout the depth of the treatment and facilitates respect of alignment of the adjacent diaphragms.

The main advantages of this solution can be summarized as follows.

- It enables execution of thin diaphragm walls (transverse size less than 500 mm and depth greater than 5-10 m) using rotating mixing elements with which optimal disaggregation of the soil through the continuous and constant action of the cutting elements is guaranteed.
- It has cutting/mixing elements (wheels) of large dimensions (5 to 15-20 times larger than the transverse dimensions). This gives the possibility to reduce the number of panels necessary and at the same time mixing in height larger layers of soil, thus guaranteeing homogeneity of characteristics through different digging depths.
- When passing through gravel, the greater diametral size (up to five times that of the milling cutters) gives the opportunity to mix the incoherent soil bringing it on top of and underneath the original layer. This makes it possible to traverse with greater ease areas of inert matrix for thicknesses proportionally greater in relation to the diameter of the tool and the thrust that can be exerted and favoured by the shape of the wheels, which are completely exposed both in the drilling direction and in the extraction direction (unlike milling cutters, which are partially shielded at the top by the supporting structure).
- The rotation in opposite directions of the wheels enables doubling the effectiveness of the cutting/disaggregation.
- The drilling of the central core of the diaphragm wall to enable insertion of the body of the tool. The section of the diaphragm wall obtained is suited, once the tool has been extracted from the panel, to being reinforced like a foundation pile.
- The invention enables advantageous use of the large diametral dimensions to provide mixing wheels in the form of flywheel disks: by conserving the rotational energy, conservation of the speed of rotation is favoured, and the cut will be constant so that a more homogeneous mixing is obtained.
- The motion-transmission members are external and enable reduction to a minimum of the distances between the wheels, thus preventing the presence of areas of the diaphragm not reached by the cutting/mixing teeth—the mechanical mixing is complete throughout the cross section.
- The solution claimed as main solution is of a completely mechanical type and hence free from problems or any breakdown due to presence of motor members directly sunk in the hole, simultaneously with injection of the cementitious mixes.
- The solution claimed as first variant enables simplification of the motion-transmission system by introducing a motor-reducer in the body of the tool and eliminating the rotary table with the corresponding internal drilling batteries. This variant is ideal when a large drilling depth is required: in this case, rod 47 may project with respect to hoisting assembly 62, and the depth may be increased proportionally.
- The solution claimed as second variant enables separation of the sources of motion between the tip and the wheels, and this is useful in the case where high torques are to be supplied maintaining the diaphragm wall thin. In this case, in fact, if it is desired to preserve the same dimensions of the diameter ØF, it is possible to leave all the torque available for the wheels and supply the tip independently, through an additional hydraulic source. The amount of torque required to the tip can be thus modulated as desired by acting on the parameters of transmission (engine displacement, reduction ratios, pressures), and the speed can be raised or lowered according to the needs, whereas normally the cutting speed of the tip is proportional to that of the wheels. In addition, in the previous solutions, the tip is mechanically coupled to the wheels, and in the case of stalling of one of the three members in motion, also the members would stop, a problem that would no longer arise if the supply were independent.
- The simplified cylindrical shape for containment of the motion-transmission systems enables execution of a pre-hole with normal drilling equipment, which then favours execution of the diaphragm wall with a drilling tool no longer equipped with tip.

The pre-hole could be used as guide for the mixing treatment in order to guarantee verticality of the panel and precision of positioning with respect to the adjacent panels.

The invention claimed is:

1. A cutting/mixing tool for thin diaphragm walls mounted at an end of at least one drilling rod moved by a slidable assembly along a tower, carried by an operating drilling machine; the tool comprising a body, which bears in a central part two digging/mixing wheels, provided on a periphery with cutting means and set facing one another, so that said wheels are free of supporting structural elements between the wheels and coaxial about an axis substantially perpendicular to a direction of digging; the wheels projecting from slits of the body, which contains at least partially means for transmitting motion to the wheels, said means being positioned externally with respect to the wheels.

2. A tool according to claim 1, wherein the wheels are counter-rotating.

3. A tool according to claim 1, wherein the wheels dig/mix a substantially rectangular diaphragm defined by the diameter of the wheels with the corresponding cutting/mixing means and by a thickness that the wheels occupy when the wheels are set alongside one another.

4. A tool according to claim 1, wherein the sliding assembly includes a rotary table, fixed to which is the external rod to enable hoisting/driving of the body by hoisting tackle and thrust tackle; the rotary motion of digging/mixing being transmitted from a rotary table to the tool by internal rods.

5. A tool according to claim 1, wherein the drilling rod is rendered temporarily releasable with respect to the digging axis; the connection between the drilling rod and the slidable assembly being motor-driven to position the digging wheels according to a pre-set inclination with respect to the positioning of the drilling tower.

6. A tool according to claim 5, wherein motor driving of the angular-positioning system is obtained by linear actuators or motors or motor-reducers that can be remotely operated and controlled with electrical or hydraulic signals.

7. A tool according to claim 1, wherein the digging/mixing wheels have a non-homogeneous cross section with a wall that is relatively slender, and an annular portion of considerable dimensions in order to concentrate heavy weights at the greater distances.

8. A cutting/mixing tool for thin diaphragm walls mounted at an end of at least one drilling rod moved by a slidable assembly along a tower, carried by an operating drilling machine; the tool comprising a body, which bears in a central part two digging/mixing wheels, provided on a periphery with cutting means and set alongside one another at a minimum distance and coaxial about an axis substantially perpendicular to a direction of digging; the wheels projecting from slits of the body, which contains at least partially means for transmitting motion to the wheels, said means being positioned externally with respect to the wheels; wherein the body is provided with a tip at a terminal end, which is equipped with cutting means and injection mouths and is turnable with respect to the axis of the body coinciding with the axis of digging.

9. A tool according to claim 8, wherein the tip is driven with a motion independent of that of the wheels obtained with a motor or motor-reducer power assembly supplied with pipes, which pass inside the drilling rod.

10. A cutting/mixing tool for thin diaphragm walls mounted at an end of at least one drilling rod moved by a slidable assembly along a tower, carried by an operating drilling machine; the tool comprising a body, which bears in a central part two digging/mixing wheels, provided on a periphery with cutting means and set alongside one another at a minimum distance and coaxial about an axis substantially perpendicular to a direction of digging; the wheels projecting from slits of the body, which contains at least partially means for transmitting motion to the wheels, said means being positioned externally with respect to the wheels; wherein the means for transmitting motion to the wheels comprise a shaft, which receives motion from a motor member; fitted on the shaft is a first pinion, meshing on which is at least one pair of second pinions, which, via a respective shaft and a third twin pinion transfer motion to a crown wheel fixed with respect to each of the digging wheels.

11. A tool according to claim 10, wherein said crown wheel transmits motion to members, which are altogether specular to the elements that from the first pinion transmit motion to the crown wheel; said members supply a final wheel, which causes rotation of the tip provided with teeth and injection mouths.

12. A cutting/mixing tool for thin diaphragm walls mounted at an end of at least one drilling rod moved by a slidable assembly along a tower, carried by an operating drilling machine; the tool comprising a body, which bears in a central part two digging/mixing wheels, provided on a periphery with cutting means and set alongside one another at a minimum distance and coaxial about an axis substantially perpendicular to a direction of digging; the wheels projecting from slits of the body, which contains at least partially means for transmitting motion to the wheels, said means being positioned externally with respect to the wheels; wherein the means for transmitting motion to the wheels comprise a shaft, which receives the motion from a motor member external to the drilling equipment; fitted on the shaft is a pinion, meshing on which is a pair of pinions; the pinions comprise a bevel gear, and a pinion, fixed with respect to the gear, is wound a chain, which is transmitted to engage a central pinion, which transmits the motion to the digging wheels.

13. A tool according to claim 12, wherein the chain proceeds a specular extension downwards with the branch that is run over the pinion, which transmits motion to a tip provided with teeth and injection mouths.

14. A cutting/mixing tool for thin diaphragm walls mounted at an end of at least one drilling rod moved by a slidable assembly along a tower, carried by an operating drilling machine; the tool comprising a body, which bears in a central part two digging/mixing wheels, provided on a periphery with cutting means and set alongside one another at a minimum distance and coaxial about an axis substantially perpendicular to a direction of digging; the wheels projecting from slits of the body, which contains at least partially means for transmitting motion to the wheels, said means being positioned externally with respect to the wheels; wherein a motor or motor-reducer power assembly is housed inside the body in the proximity of a motor pinion, having as connection rod the drilling rod; wherein contained inside the rod are supply pipes, which reach up to a hoisting assembly.

15. A cutting/mixing tool for thin diaphragm walls mounted at an end of at least one drilling rod moved by a slidable assembly along a tower, carried by an operating drilling machine; the tool comprising a body, which bears in a central part two digging/mixing wheels, provided on a periphery with cutting means and set alongside one another at a minimum distance and coaxial about an axis substantially perpendicular to a direction of digging; the wheels projecting from slits of the body, which contains at least partially means for transmitting motion to the wheels, said means being positioned externally with respect to the wheels; wherein the digging and mixing tool is equipped with a plurality of injection nozzles positioned and set at different angles in positions corresponding to the wheels for introduction of the fluids into the ground.

16. A tool according to claim 15, wherein further nozzles are arranged on a digging tip and enable injection of drilling fluids during digging to facilitate removal of the debris and cool the tip.

* * * * *